United States Patent [19]

Ishizuka

[11] 4,379,425

[45] Apr. 12, 1983

[54] DOUBLE-ACTING PISTON FOR SWASH-PLATE TYPE COMPRESSORS

[75] Inventor: Yutaka Ishizuka, Konan, Japan

[73] Assignee: Diesel Kiki Co., Ltd., Saitama, Japan

[21] Appl. No.: 208,540

[22] Filed: Nov. 20, 1980

[30] Foreign Application Priority Data

Nov. 30, 1979 [JP] Japan ..... 54-165681[U]
May 24, 1980 [JP] Japan ..... 55-71388[U]

[51] Int. Cl.³ ..... F01B 3/02; F04B 1/16; B23P 15/10

[52] U.S. Cl. ..... 92/71; 417/269; 91/502; 29/156.4 R

[58] Field of Search ..... 92/71, 260; 29/156.4 R, 29/156.5 R; 91/502; 417/269, 220

[56] References Cited

U.S. PATENT DOCUMENTS

| | | | |
|---|---|---|---|
| 1,837,724 | 12/1931 | Michell | 29/156.5 R |
| 2,434,747 | 1/1948 | Ruben | 92/71 |
| 2,673,769 | 3/1954 | Morrison et al. | 92/260 |
| 2,896,316 | 7/1959 | Schmidt et al. | 29/156.5 R |
| 3,319,575 | 5/1967 | Havens | 92/260 |
| 3,369,465 | 2/1968 | Harrah | 29/156.5 R |
| 3,538,574 | 11/1970 | Toma et al. | 29/156.5 R |
| 3,894,904 | 10/1976 | Schlecht | 29/156.5 R |

*Primary Examiner*—William L. Freeh
*Attorney, Agent, or Firm*—Frishauf, Holtz, Goodman & Woodward

[57] ABSTRACT

A double-acting piston is provided which is slidably mounted within a cylinder bore formed within the framework of a swash-plate type compressor, for carrying out a fluid compressing action. The piston comprises a pair of piston heads provided at its opposite ends and an intermediate coupling member coupling the piston heads to each other. The piston heads and the intermediate coupling member are separately fabricated from discrete pieces by means of stamping or the like. The piston heads each comprise a hollow first part extending axially inwardly of the piston and a hollow cylindrical second part extending radially outwardly from an outer end of the first part and serving as a slider. The first and second parts of the piston heads may be separately fabricated from discrete pieces by means of stamping or the like. The first parts of the piston heads have their opposed end faces formed integrally with either ball pockets for receiving balls which engage the swash plate via shoes or semispherical protuberances for engagement with shoes which are arranged in sliding contact with the opposite side surfaces of the swash plate.

14 Claims, 10 Drawing Figures

DOUBLE-ACTING PISTON FOR SWASH-PLATE TYPE COMPRESSORS

BACKGROUND OF THE INVENTION

This invention relates to swash-plate type compressors for use in air conditioning systems for automotive vehicles, and particularly to double-acting pistons which are placed within cylinder bores formed within the compressors for sliding in the cylinder bores in unison with the rotation of the swash plate.

A conventional swash-plate type compressor used in an air conditioning system for automotive vehicles generally includes double-acting pistons slidably received within cylinder bores formed within the cylinder blocks forming the framework of the compressor, and a swash plate secured on the drive shaft extending through the cylinder blocks and engaging the pistons. The pistons each comprises a casting formed integrally with two piston heads at its opposite ends and an intermediate coupling part coupling the piston heads to each other. The intermediate coupling part has an axially central portion formed with a recess in which the swash plate is engaged. This recess traverses the axially central portion of the intermediate coupling part and has opposite end walls formed with ball pockets. The swash plate has a peripheral fringe engaged within the recess via balls received in the ball pockets and shoes held between the balls and the opposite side surfaces of the swash plate. With this arrangement, when the drive shaft rotates, the swash plate is correspondingly rotated while sliding relative to the shoes to cause reciprocal motions of the pistons for compressing fluid such as refrigerant.

Since the cylinder blocks and the pistons are each formed of a one-piece casting, they should not be made of a metal having a large specific gravity such as steel, in view of the castability of steel and the necessity of obtaining a lightweight compressor. Therefore, the cylinder blocks and the pistons are both formed of aluminum alloy castings.

The conventional swash-plate type compressor having the above construction has the following drawbacks:

1. The cylinder blocks and the pistons which are both made of an aluminum alloy are apt to adhere to each other when heated, often causing seizure between the piston heads of the pistons and the cylinder bores.
2. At the portion where each piston engages the swash plate many parts are used which include balls and shoes. The balls and the shoes may easily slip off the swash plate and the piston in mounting them, thus making the assembly operation troublesome and time-consuming.

OBJECTS AND SUMMARY OF THE INVENTION

It is a primary object of the invention to provide a double-acting piston for use in a swash-plate type compressor, which is light in weight and is made of a material which does not easily adhere to the cylinder blocks, to thereby overcome the above-mentioned drawbacks.

It is a further object of the invention to provide a double-acting piston for use in a swash-plate type compressor, which includes a minimum of parts used at the portion where each piston engages the swash plate, to facilitate the assembly operation.

According to the invention, the double-acting piston comprises a pair of piston heads provided at opposite ends thereof and an intermediate coupling member interposed between the piston heads to couple same to each other. Each piston head comprises a hollow first part extending axially inwardly of the piston and a hollow cylindrical second part extending radially outwardly from the first part and having a peripheral lateral surface adapted for sliding contact with the inner peripheral surfaces of the cylinder bores within which the piston is received. Each piston head is formed of at least one discrete piece. The intermediate coupling member is formed of a piece separate from the at least one discrete piece forming each piston head. The piston heads and the intermediate coupling member are joined together by welding or other suitable means. The first parts of the piston heads have opposed inner ends spaced from each other and cooperating with the intermediate coupling member to define therebetween a central recess opening radially inwardly of the compressor and in which the swash plate has its peripheral fringe engaged via shoes. The opposed inner ends of the piston heads are each formed with either a ball pocket in the form of a semispheric recess for receiving a ball engaging a shoe or a semispheric protuberance for directly engaging a shoe.

The above objects, other objects, features and advantages of the invention will be more apparent from the ensuing detailed description taken in connection with the accompanying drawings:

DETAILED DESCRIPTION

Figure 1:
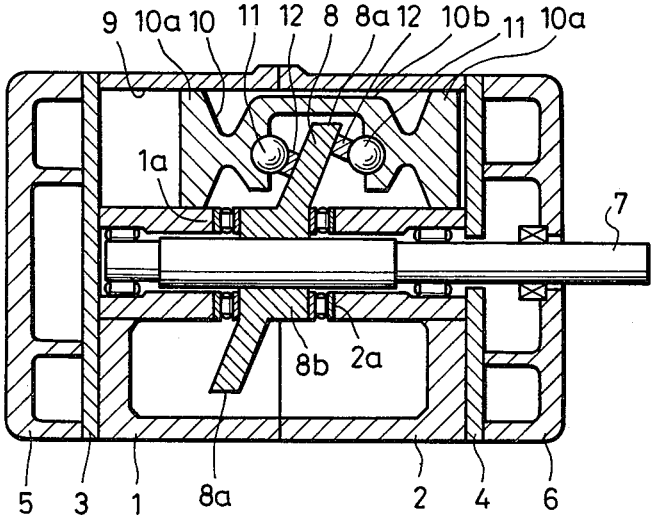
FIG. 1 PRIOR ART
FIG. 1 is a longitudinal sectional view showing a conventional swash-plate type compressor.
Figure 2:
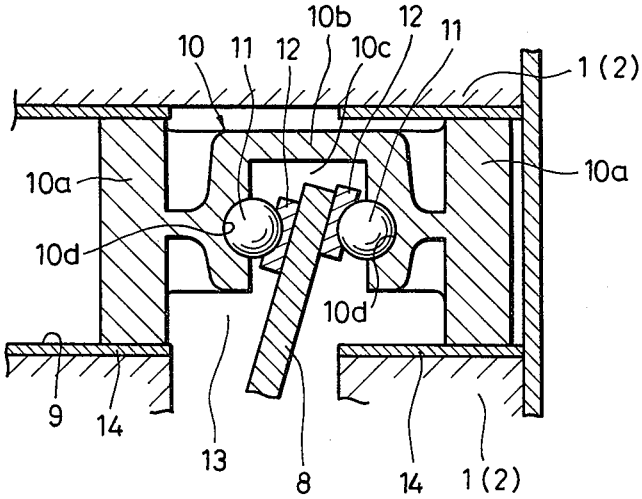
FIG. 2 PRIOR ART
FIG. 2 is an enlarged longitudinal sectional view showing a piston used in the compressor of FIG. 1 and its peripheral portions.
Figure 3:
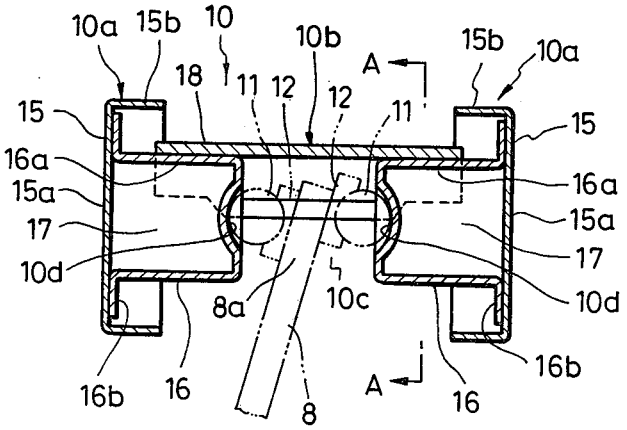
FIG. 3 is a longitudinal sectional view showing a piston for use in a swash-plate type compressor, according to a first embodiment of the present invention.
Figure 4:
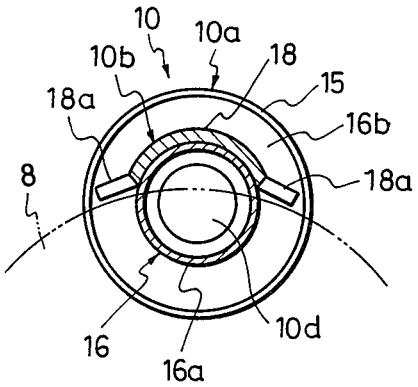
FIG. 4 is a sectional view taken along line A—A of FIG. 3.
Figure 5:
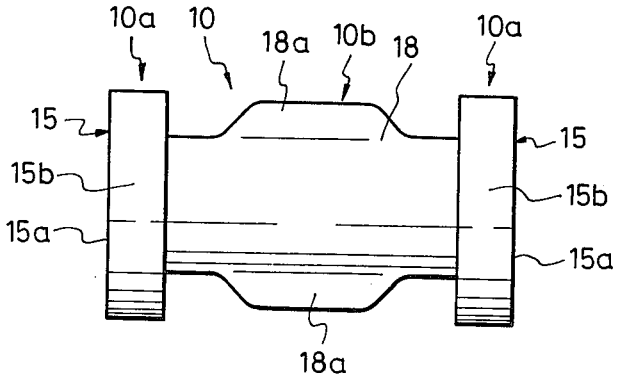
FIG. 5 is a top plan view of the piston of FIG. 3.
Figure 6:
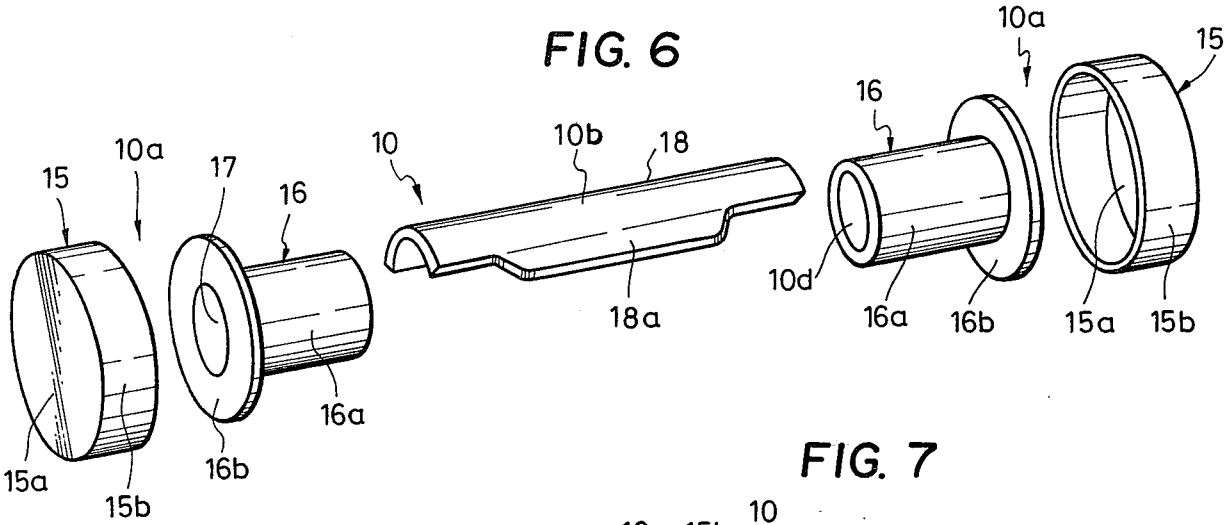
FIG. 6 is an exploded perspective view of the piston of FIG. 3.

Referring now to the drawings, wherein like reference characters designate like or corresponding parts throughout the several views, FIGS. 1 and 2 illustrate a swash-plate type compressor which is used in general and in which conventional pistons are used. A pair of cylinder blocks 1, 2 are joined together in axial alignment at their inner ends. Two cylinder heads 5, 6 are mounted on the outer ends of the respective cylinder blocks 1, 2 with valve plates 3, 4 intervening therebetween. A drive shaft 7 extends through the cylinder head 6 and the cylinder blocks 1, 2 along their axes for rotation relative to the cylinder blocks 1, 2. A swash plate 8 is arranged within the cylinder blocks 1, 2, which has a central boss 8b secured to the drive shaft 7. A plurality of cylinder bores 9 (only one of them is shown) axially extend through the cylinder blocks 1, 2 within which are slidably received so many pistons 10 which are of double-acting type. The pistons 10 each have a central recess 10c in which the swash plate 8 has its peripheral fringe 8a engaged via balls 11 and shoes 12. With this arrangement, when the drive shaft 7 rotates, the swash plate 8 is correspondingly rotated to make the piston 10 reciprocally move within their respective cylinder bores 9 to carry out pumping actions.

The pistons 10 each have its opposite ends formed integrally with piston heads 10a, 10a which are integrally coupled together by means of an intermediate coupling part 10b integrally formed therebetween. The intermediate coupling part 10b has a central portion depressed to form the above-mentioned central recess 10c. This central recess 10c traverses the central portion of the coupling part 10b and has its opposite end walls formed with ball pockets 10d, 10d in which are received balls 11, 11. Shoes 12, 12 are held between these balls 11, 11 and the swash plate 8 to engage the swash plate 8 with the piston 10. This swash plate 8 is arranged within a swash plate chamber 13 defined within the cylinder blocks 1, 2.

The cylinder blocks 1, 2, used in the illustrated conventional compressor have a rather complicated internal structure since it is formed with various bores or internal spaces including the cylinder bores 9 and the swash plate chamber 13. Therefore, these cylinder blocks 1, 2 have to be made of a material excellent in castability by means of casting. For this reason, the cylinder blocks 1, 2 are usually cast from an aluminum alloy. On the other hand, the pistons 10 are conventionally also cast from an aluminum alloy, in view of their complicated configuration as noted above and in order to comply with the need of reducing their weights.

Since the pistons 10 and the cylinder blocks 1, 2 are thus both made of an aluminum alloy, they are apt to adhere to each other when heated, often causing an accident of seizure of the piston heads 10a, 10a of the piston 10 on the cylinder bore 9 during the sliding action of the piston. To prevent such an accident, conventionally the sliding inner surfaces of the cylinder bores 9 are plated with chrome or alternatively lined with liners 14, 14 made of cast iron as illustrated in FIG. 2. However, the operation of chrome plating or providing liners on the inner surfaces of the cylinder bores 9 is very troublesome, leading to high production costs.

If the piston 10 itself is made of a material which does not well adhere to the cylinder blocks 1, 2, such as cast iron, the seizure accident can be avoided. However, then the piston 10 would be heavy in weight, leading to large energy loss.

FIGS. 3 through 6 illustrate a piston 10 for swash-plate type compressors, according to an embodiment of the present invention. The piston 10 comprises a pair of piston heads 10a, 10a provided at its opposite ends and an intermediate coupling part 10b coupling these piston heads 10a, 10a to each other.

The piston heads 10a, 10a each comprise a sliding part or slider 15 for sliding contact with the inner surface of a cylinder bore, and a ball receiving part 16 for engagement with a ball 11, the two parts 15, 16 being both formed of discrete or separate metal plates by means of stamping and joined together by suitable means as hereinafter referred to. The sliding parts 15, 15 each have a hollow cylindrical body having an open inner end and a closed outer end formed with an outer end wall. Each sliding part 15 has its outer end surface 15a serving as the top end surface of the respective piston head 10a and its peripheral lateral surface 15b serving as the sliding surface of the piston head 10a which is to be disposed in sliding contact with the inner surface of the cylinder bore. On the other hand, the ball receiving parts 16, 16 each comprise a hollow cylindrical portion 16a and a flange 16b integrally extending radially outwardly from the outer end of the hollow cylindrical portion 16a. The flange 16b is secured to the inner surface of the outer end wall 15a of the associated sliding part 15 by means of spot welding, projection welding, caulking, adhesion, etc. Each ball receiving part 16 has its inner end surface formed with a ball pocket 10d in the form of a generally semispheric recess in which is to be received a ball 11. The piston heads 10a, 10a, which are each formed of the sliding part 15 and the ball receiving part 16 which are stamped from metal plates, each have an internal space 17 defined within these parts 15, 16. Therefore, the piston 10 is much lighter in weight than a conventional piston.

The intermediate coupling part 10b comprises a discrete member 18 having an arcuate cross section which is stamped from a metal plate. The member 18 is secured at its opposite end portions to the cylindrical portions 16a, 16a of the ball receiving parts 16, 16 of the piston heads 10a, 10a by means of spot welding, projection welding, caulking, adhesion, etc. to couple the opposite piston heads 10a, 10a to each other. The ball receiving parts 16, 16 have their opposed inner ends spaced from each other so that a central recess 10c is defined by the lower side surface of the coupling member 18 and the inner end surfaces of the ball receiving parts 16, 16. The swash plate 8 has its peripheral fringe 8a engaged in the central recess 10c via the balls 11, 11 and the shoes 12, 12. The member 18 forming the coupling part 10b has its central lateral sides formed with reinforcing wings 18a, 18a extending circumferentially of the member 18.

To assemble the piston 10 having the above described construction, first each sliding part 15 and each ball receiving part 16, both previously formed by stamping from metal plates, are joined together by the aforementioned means such as spot welding, to form a piston head 10a. Then, the coupling member 18 of the coupling part 10b is joined to the ball receiving parts 16, 16 of the piston heads 10a, 10a by the aforementioned means such as spot welding.

Since as noted above, the hollow ball receiving parts 16, 16, the hollow sliding parts 15, 15 and the plate-like coupling member 18 are fabricated in separate pieces by stamping and joined together by the aforementioned means, the piston 10 thus completed has a weight much smaller than a conventional one even if it is made of a metal having a large specific gravity such as steel including stainless steel, as long as the constituent material of the member 15 has low adherence to the constituent material of the cylinder blocks. Therefore, it is possible to prevent the occurrence of seizure of the sliding machine parts without addition of any measures such as chrome plating on the inner surfaces of the cylinder bores.

In assembling the piston 10, alternatively of the above-mentioned assembling sequence, the coupling of the coupling member 18 to the ball receiving parts 16, 16 may be previously effected, followed by joining the sliding parts 15, 15 to the ball receiving parts 16, 16.

Figure 7:
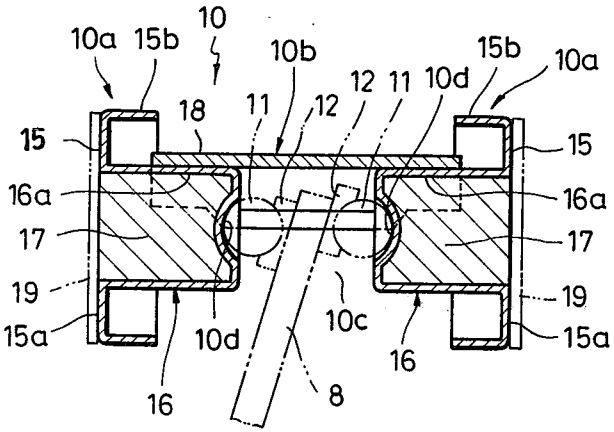
FIG. 7 is a longitudinal sectional view showing a piston for use in a swash-plate type compressor, according to a second embodiment of the present invention.

FIG. 7 illustrates a piston according to a further embodiment of the invention. The piston 10 according to this embodiment is distinguished from the piston according to the previously described embodiment in that the sliding part 15 and ball receiving part 16 of each piston head 10*a* are integrally fabricated in one piece from a single metal plate by stamping, and the internal space 17 within the ball receiving part 16 is filled with synthetic resin. According to this embodiment, the number of the parts forming the piston can be reduced.

More specifically, the piston heads 10*a*, 10*a* each comprise a hollow cylindrical ball receiving part 16 which has an inner end surface formed with a ball pocket 10*d* in the form of a generally semispheric recess, and a sliding part 15 which is formed of a radial portion 15*a* integrally extending radially outwardly from the outer end of the ball receiving part 16 and an axial portion 15*b* integrally extending axially inwardly from the peripheral edge of the raadial portion 15*a*. The outer end surface of the radial portion 15*a* serves as the top end surface of the piston head 10*a* and the peripheral lateral surface of the axial portion 15*b* serves as the sliding surface of same.

The outer end of each piston head 10*a* is opened with the internal space 17 within the ball receiving part 16 exposed to the outside through the open outer end. The synthetic resin in the internal space 17, which is charged there through the open outer end increases the strength of the piston head 10*a*.

Instead of filling synthetic resin in the space 17, alternatively a disc plate 19 may be joined to the radial portion 15*a* of the slider 15 as indicated by the chain line in FIG. 7, by means of spot welding, projection welding, caulking, adhesion, etc. so as to cover the opening in the outer end of the piston head 10*a*. In this alternative case, the internal space 17 need not be filled with synthetic resin, thus making the piston 10 lighter in weight.

Figure 8:
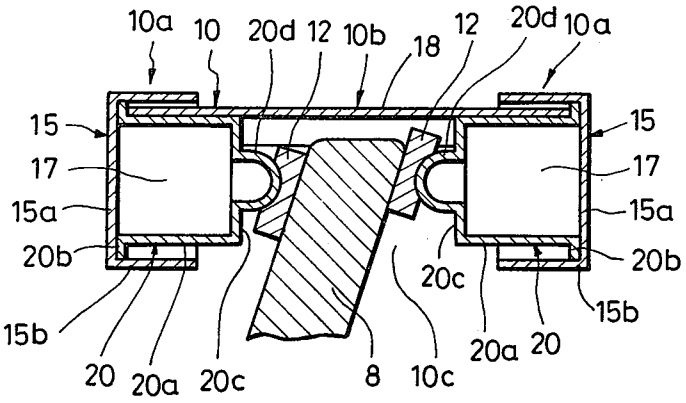
FIG. 8 is a longitudinal sectional view showing a piston for use in a swash-plate type compressor, according to a third embodiment of the present invention.

FIG. 8 illustrates a further embodiment of the invention. The piston 10 according to this embodiment is distinguished from the piston according to the embodiment shown in FIGS. 3 through 6 in that the ball receiving part of each piston head 10*a* and the ball are integrally fabricated in one piece from a single metal plate by stamping.

More specifically, reference numeral 20 designates a shoe seating member forming part of each piston head 10*a*. Each shoe seating member 20 comprises a hollow cylindrical body which has a cylindrical portion 20*a* and a flange 20*b* integrally extending radially outwardly from the outer end of the cylindrical portion 20*a*. The cylindrical portion 20*a* has its inner end face 20*c* formed integrally with a generally semispheric protuberance 20*d*. Each shoe seating member 20 is formed of a single metal plate by stamping. The two members 20 are joined at the flanges 20*b* to the inner side surfaces of the outer end walls 15*a*, 15*a* of the respective sliders 15, 15 which are each formed by a hollow cylindrical body, by means similar to those applied to the embodiment shown in FIGS. 3 through 6. When the piston 10 is engaged with the swash plate 8, the protuberance 20*d*, 20*d* are disposed to have the shoes 12, 12 seated thereon, the shoes being arranged in contact with the opposite side surfaces of the swash plate 8.

The other parts of the piston 10 according to this embodiment are similar to or identical with the corresponding parts of the embodiment shown in FIGS. 3 through 6. Description of these other parts is therefore omitted.

The structure of the embodiment of FIG. 8 can dispense with balls, thus leading to a reduction in the number of the constituent parts and eliminating the possibility that balls slip off when the piston is mounted onto the swash plate to facilitate the mounting operation.

Figure 9:
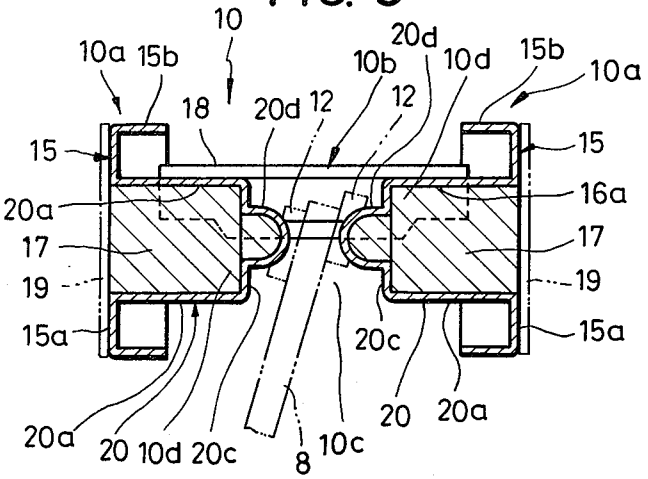
FIG. 9 is a longitudinal sectional view showing a piston for use in a swash-plate type compressor, according to a fourth embodiment of the present invention.
Figure 10:
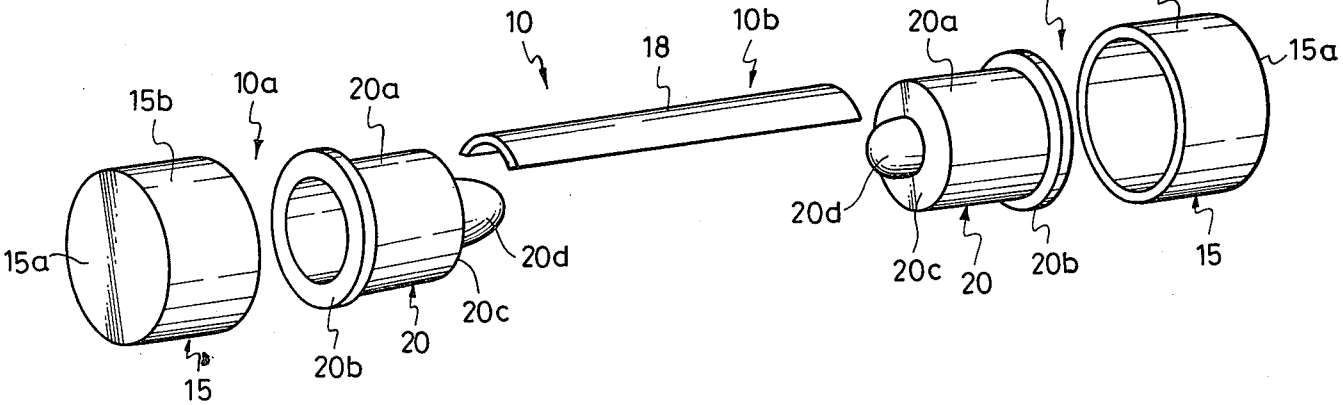
FIG. 10 is an exploded perspective view showing the piston of FIG. 8.

FIG. 9 illustrates a piston 10 according to a still further embodiment of the invention. This embodiment is different from the embodiment of FIG. 8 in that the slider 15 and shoe seating part 20 of each piston heads 10*a* are formed in one piece from a single metal plate by stamping and the internal space 17 formed within the shoe seating part 20, 20 is filled with synthetic resin. According to this embodiment, the number of the parts forming the piston can further be reduced.

The piston 10 of the embodiment of FIG. 9 has a structure generally similar to that of the embodiment of FIG. 7 which comprises shoe seating parts 20, 20 which each have an inner end surface 20*c* formed with a generally semispheric protuberance 20*d*, and sliders 15, 15 which are each formed of a radial portion 15*a* integrally extending radially outwardly from the outer end of the respective shoe seating part 20 and an axial portion 15*b* integrally extending axially inwardly from the peripheral edge of the radial portion 15*a*. The internal spaces 17, 17 defined within the shoe seating parts 20, 20 which open to the outside are filled with synthetic resin.

As is the same with the embodiment of FIG. 7, a disc plate 19 may be joined to the outer end face the radial portion 15*a* of each slider 15, as shown by the chain line in FIG. 9, by similar means to those applied to the embodiment of FIG. 7, to isolate the internal spaces 17, 17 from the outside to make it unnecessary to fill synthetic resin in the spaces 17, 17 for reduction in the weight of the piston heads.

Obviously many modifications and variations of the present invention are possible in the light of the above teachings. It is therefore to be understood that within the scope of the appended claims the invention may be practiced otherwise than as specifically described.

What is claimed is:

1. A double-acting piston for use in a swash-plate type compressor of the type including a frame having at least one cylinder bore formed therein, a drive shaft axially extending through said frame, a swash plate secured on said drive shaft, and shoes arranged in sliding contact with said swash plate at opposite side surfaces thereof; said double-acting piston comprising:

a pair of piston heads provided at opposite ends of said piston, said piston heads each having a first part which includes a first hollow cylindrical member extending axially inwardly of said piston and a second part which includes a second hollow cylindrical member extending radially outwardly from said first part, said piston heads each having a peripheral lateral surface adapted for sliding contact with an inner peripheral surface of said cylinder bore, said piston heads each being formed of at least one piece and said first and second hollow cylindrical members being formed of respective separate pieces;

an intermediate coupling member interposed between said piston heads to couple same to each other, said intermediate coupling member comprising a piece separate from said at least one piece forming each of said piston heads;

means joining said piston heads and said intermediate coupling member to each other;

said first parts of said piston heads each having opposed inner ends thereof spaced from each other and cooperating with said intermediate coupling member to define therebetween a central recess opening radially inwardly of said compressor, said first hollow cylindrical member forming said first part of each of said piston heads having an inner end face formed with a ball pocket in the form of a ball-receiving recess; and a pair of generally ball-shaped members respectively engaged in said ball-receiving recesses of said first hollow cylindrical members, said generally ball-shaped members being spaced from each other in the axial direction of said piston, said space between said generally ball-shaped members being in said central recess opening defined between said inner ends of said first parts;

said swash plate having a peripheral fringe portion thereof engaged in said space between said generally ball-shaped members via said shoes which respectively engage between one of said generally ball-shaped members and said swash plate.

2. A double-acting piston for use in a swash-plate type compressor of the type including a frame having at least one cylinder bore formed therein, a drive shaft axially extending through said frame, a swash plate secured on said drive shaft, and shoes arranged in sliding contact with said swash plate at opposite side surfaces thereof; said double-acting piston comprising:

a pair of piston heads provided at opposite ends of said piston, said piston heads each having a first part which includes a first hollow cylindrical member extending axially inwardly of said piston and a second part which includes a second hollow cylindrical member extending radially outwardly from said first part, said piston heads each having a peripheral lateral surface adapted for sliding contact with an inner peripheral surface of said cylinder bore, said piston heads each being formed of at least one piece and said first and second hollow cylindrical members being formed of respective separate pieces;

an intermediate coupling member interposed between said piston heads to couple same to each other, said intermediate coupling member comprising a piece separate from said at least one piece forming each of said piston heads; and means joining said piston heads and said intermediate coupling member to each other;

said first parts of said piston heads each having opposed inner ends thereof spaced from each other and cooperating with said intermediate coupling member to define therebetween a central recess opening radially inwardly of said compressor, said first hollow cylindrical member forming said first part of each of said piston heads having an inner end surface formed with a protuberance projecting therefrom for respectively engaging one of said shoes, said protuberances being spaced from each other in the axial direction of said piston, said space between said protuberances being in said central recess opening defined between said inner ends of said first parts;, said swash plate having a peripheral fringe portion thereof engaged in said space between said protuberances via said shoes which respectively engage between one of said protuberances and said swash plate.

3. A double-acting piston for use in a swash-plate type compressor of the type including a frame having at least one cylinder bore formed therein, a drive shaft axially extending through said frame, a swash plate secured on said drive shaft, and shoes arranged in sliding contact with said swash plate at opposite side surfaces thereof; said double-acting piston comprising:

a pair of piston heads provided at opposite ends of said piston, said piston heads each having a first part which includes a first hollow cylindrical member extending axially inwardly of said piston and a second part which includes a second hollow cylindrical member extending radially outwardly from said first part, said piston heads each having a peripheral lateral surface adapted for sliding contact with an inner peripheral surface of said cylinder bore, said piston heads each being formed of at least one piece and said first and second hollow cylindrical members being formed of respective separate pieces;

said first hollow cylindrical member forming said first part of each of said piston heads having a flange integrally extending radially outwardly from an outer end thereof, and said second hollow cylindrical member forming said second part of each of said piston heads having an open inner end and a closed outer end formed with an outer end wall, said first hollow cylindrical member extending through said open inner end of said second hollow cylindrical member and having said flange joined to an inner side surface of said outer end wall of said second hollow cylindrical member;

an intermediate coupling member interposed between said piston heads to couple same to each other, said intermediate coupling member interposed between said piston heads to couple same to each other, said intermediate coupling member comprising a piece separate from said at least one piece forming each of said piston heads; and means joining said piston heads and said intermediate coupling member to each other;

said first hollow cylindrical members of said piston heads each having opposed inner ends thereof spaced from each other and cooperating with said intermediate coupling member to define therebetween a central recess opening radially inwardly of said compressor, said swash plate having a peripheral fringe portion thereof engaged with said inner ends of said first parts in said central recess via said shoes which respectively engage between said inner end of one of said first parts and said swash plate.

4. A double-acting piston for use in a swash-plate type compressor of the type including a frame having at least one cylinder bore formed therein, a drive shaft axially extending through said frame, a swash plate secured on said drive shaft, and shoes arranged in sliding contact with said swash plate at opposite side surfaces thereof, said double-acting piston comprising:

a pair of piston heads provided at opposite ends of said piston, said piston heads each having a first part which includes a hollow body portion extending axially inwardly of said piston and a second part which includes a hollow cylindrical body portion extending radially outwardly from said first part, said piston heads each having a peripheral lateral surface adapted for sliding contact with an inner peripheral surface of said cylinder bore, said piston heads each being formed of a one-piece member forming said first and second parts;

said one-piece member each comprising a hollow cylindrical first part and a second part having a radial portion integrally extending radially outwardly from an outer end of said first part and an axial portion integrally extending axially inwardly from a peripheral edge of said radial portion, said axial portion of said second part having said peripheral lateral surface adapted for sliding contact with an inner peripheral surface of said cylinder bore;

an intermediate coupling member interposed between said piston heads to couple same to each other, said intermediate coupling member being formed of a piece separate from said at least one piece forming each of said piston heads; and means joining said piston heads and said intermediate coupling member to each other; wherein said first parts of said piston heads have opposed inner ends thereof spaced from each other and cooperating with said intermediate coupling member to define therebetween a central recess opening radially inwardly of said compressor, said swash plate having a peripheral fringe thereof engaged in said central recess via said shoes.

5. The double-acting piston as claimed in any one of claims 1, 2 or 3, wherein said first and second hollow cylindrical members forming said first and second parts of each of said piston heads are stamped from separate plates of different metals.

6. The double-acting piston as claimed in any one of claims 1, 2 or 3, wherein said cylinder bore has an inner wall made of metal, and said second hollow cylindrical member forming said second part of each of said piston heads is stamped from a plate of a metal having low adherence to the metal forming the inner wall of said cylinder bore.

7. The double-acting piston as claimed in any one of claims 1, 2 or 3, wherein said second hollow cylindrical member forming said second part of each of said piston heads is stamped from a steel plate.

8. The double-acting piston as claimed in claim 4, wherein said one-piece member of each of said piston heads is stamped from a plate of a metal having low adherence to a metal forming the inner wall of said cylinder bore.

9. The double-acting piston as claimed in claim 4, wherein said hollow cylindrical first part has an open outer end, said first part having an internal space filled with synthetic resin charged therein through said open outer end.

10. The double-acting piston as claimed in claim 4, wherein said hollow cylindrical first parts each have an inner end surface formed with a ball-receiving recess therein for receiving a generally ball-shaped member for engaging one of said shoes.

11. The double-acting piston as claimed in claim 4, wherein said hollow cylindrical first portion has an inner end surface formed with a protuberance projecting therefrom for respectively engaging one of said shoes.

12. The double-acting piston as claimed in any one of claims 1, 2, 3 or 4, wherein said intermediate coupling member is stamped from a metal plate.

13. The double-acting piston as claimed in claim 2 or 11, wherein said protuberances each have a substantially semispherical end portion which respectively engages one of said shoes.

14. The double-acting piston as claimed in claim 1 or 10, wherein said ball-receiving recess in each of said inner ends of said first parts is a generally part-semispherical recess for receiving a generally ball-shaped member therein.

* * * * *